US006705844B2

(12) United States Patent
Engländer

(10) Patent No.: US 6,705,844 B2
(45) Date of Patent: Mar. 16, 2004

(54) DYNAMIC SEAL

(75) Inventor: Heinrich Engländer, Linnich (DE)

(73) Assignee: Leybold Vakuum GmbH, Koln (DE)

( * ) Notice: Subject to any disclaimer, the term of this patent is extended or adjusted under 35 U.S.C. 154(b) by 0 days.

(21) Appl. No.: 10/203,056

(22) PCT Filed: Dec. 9, 2000

(86) PCT No.: PCT/EP00/12469

§ 371 (c)(1),
(2), (4) Date: Jul. 31, 2002

(87) PCT Pub. No.: WO01/57403

PCT Pub. Date: Aug. 9, 2001

(65) Prior Publication Data

US 2003/0108440 A1 Jun. 12, 2003

(30) Foreign Application Priority Data

Feb. 1, 2000 (DE) ..... 100 04 263

(51) Int. Cl.[7] ..... F04B 35/04; F16J 15/34

(52) U.S. Cl. ..... 417/423.4; 417/423.11; 415/90; 415/174.5; 277/400; 277/401

(58) Field of Search ..... 277/391, 400, 277/401, 408; 415/90, 171.1, 174.5, 203; 417/423.11, 423.4

(56) References Cited

U.S. PATENT DOCUMENTS

| | | | | |
|---|---|---|---|---|
| 1,715,597 A | | 6/1929 | Haug | |
| 2,127,865 A | | 8/1938 | Goddard | 286/9 |
| 3,109,658 A | * | 11/1963 | Barrett et al. | 277/400 |
| 3,399,827 A | | 9/1968 | Schwartzman | 230/116 |
| 3,466,052 A | * | 9/1969 | Ludwig | 277/377 |
| 3,957,277 A | | 5/1976 | Margnelli | 277/56 |
| 4,199,154 A | | 4/1980 | Mueller | 277/53 |
| 4,460,180 A | | 7/1984 | Koistinen | 277/3 |
| 4,512,725 A | | 4/1985 | Saulgeot | 417/366 |
| 4,655,681 A | * | 4/1987 | Mori et al. | 415/100 |
| 4,734,018 A | * | 3/1988 | Taniyama et al. | 417/423.4 |
| 5,165,872 A | | 11/1992 | Fleischmann et al. | 417/423.4 |
| 5,222,742 A | | 6/1993 | Roberts | 277/3 |
| 5,499,902 A | * | 3/1996 | Rockwood | 415/113 |
| 6,152,452 A | * | 11/2000 | Wang | 277/400 |
| 6,419,461 B2 | * | 7/2002 | Okada | 417/373 |

FOREIGN PATENT DOCUMENTS

| | | |
|---|---|---|
| DE | 32 21 380 | 7/1923 |
| DE | 491 159 | 2/1930 |
| DE | 23 221 | 5/1952 |
| DE | 24 40 141 | 4/1975 |
| EP | 0 408 791 | 1/1991 |
| FR | 2602834 | 2/1988 |

OTHER PUBLICATIONS

Wood, et al., "Performance of Centrifugal Shaft Seals For High–Temperature, High–Pressure Liquids", Machine Design, Jan. 30, 1964, p. 129–136.

* cited by examiner

*Primary Examiner*—Charles G. Freay
(74) *Attorney, Agent, or Firm*—Fay, Sharpe, Fagan, Minnich & McKee, LLP

(57) ABSTRACT

A seal is disposed between a rotating part and a stationary part. At least one of the parts is provided with projections which protrude into the seal gap. The seal gap (5) extends approximately radially so that both parts are provided with projections which extend in an axial direction, which are located concentrically in relation to the axis of rotation of the rotating parts and which engage with each other. Said projections are configured in the form of rows of blade-like elements. This effectively seals approximately radially extending seal gaps.

12 Claims, 5 Drawing Sheets

FIG. 3
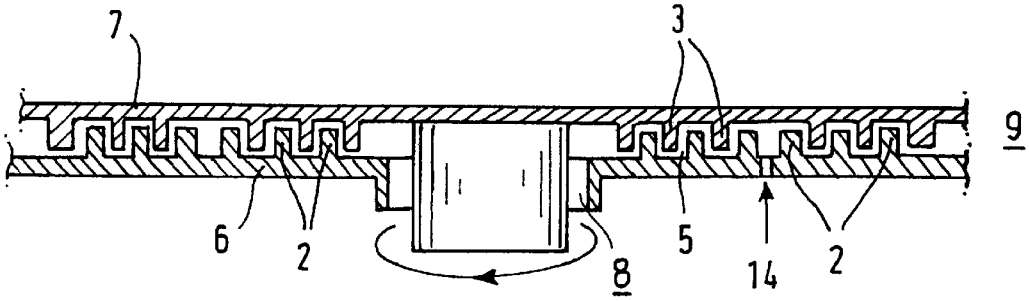
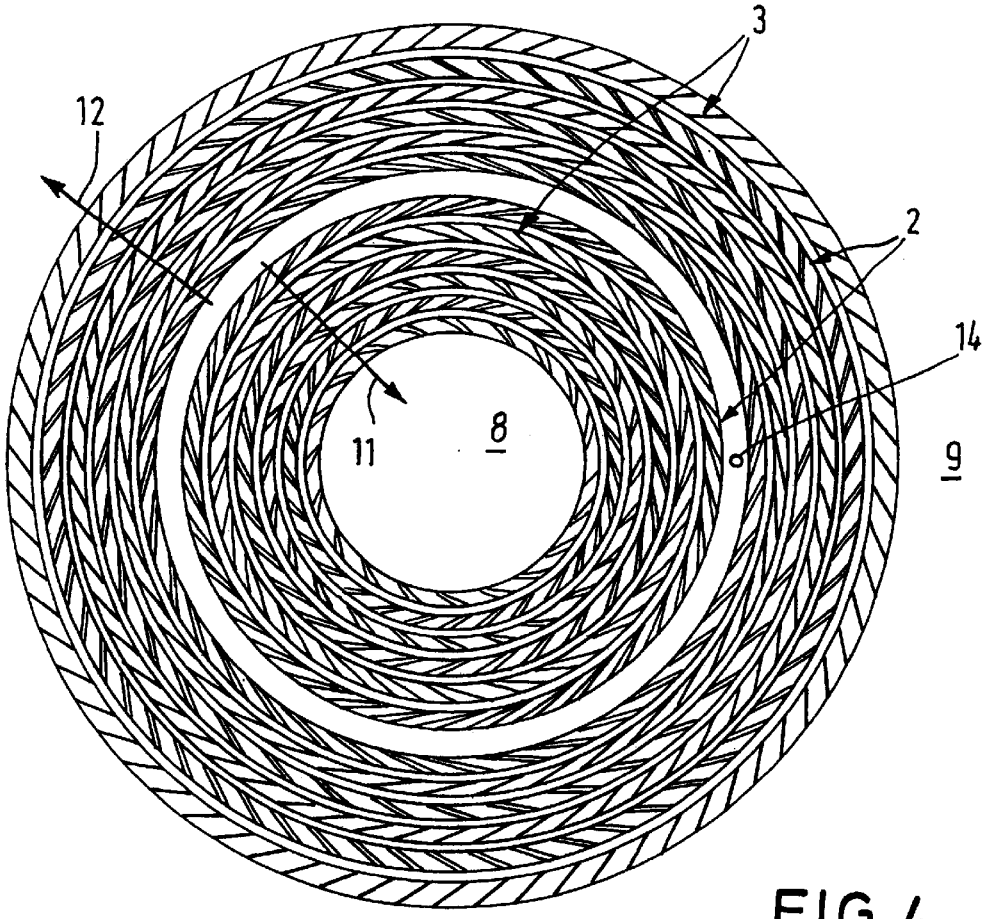
FIG. 4

DYNAMIC SEAL

BACKGROUND OF THE INVENTION

The present invention relates to a dynamic seal between a rotating part and a stationary part where at least one of the parts is provided with projections which protrude into the seal gap.

In particular in the instance of vacuum pumps there frequently exists the requirement of having to seal shafts which penetrate a separating wall between two chambers at different pressures. Commonly, labyrinth seals are employed to this end, as is also known from U.S. Pat. No. 3,399,827, for example.

In the instances of seals for gaps extending approximately radially it is known (c.f. U.S. Pat. No. 5,165,872, gap seal 43 in FIG. 5) to employ purge gases (nitrogen, argon or alike) to protect, for example, a bearing/motor chamber against the ingress of detrimental gases. The purge gas is admitted into the bearing/motor chamber and passes through the seal for the gap into the pump chamber so that it is ensured that gases can not pass from the pump chamber into the motor chamber.

SUMMARY OF THE INVENTION

It is the task of the present invention to create an effective dynamic seal for gaps extending approximately radially between a rotating and a stationary component. This task is solved through the characterizing features of the patent claims.

Through the employment of projections designed by way of engaging rows of blades, not only can the desired sealing effect be improved; moreover, there exists the possibility of assigning to the seal pumping properties beneficial to the application in each instance. If, for example, a chamber is to be protected against the ingress of gases, the rows of blades, respectively the angle of incidence for the blades forming the rows of blades, may be so selected that the seal provides a pumping action in a direction opposed to the direction of the flow of the detrimental gases.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIGS. 3 and 4 are section al views through a double flow embodiment;

DETAILED DESCRIPTION OF THE PREFERRED EMBODIMENTS

Figure 1:
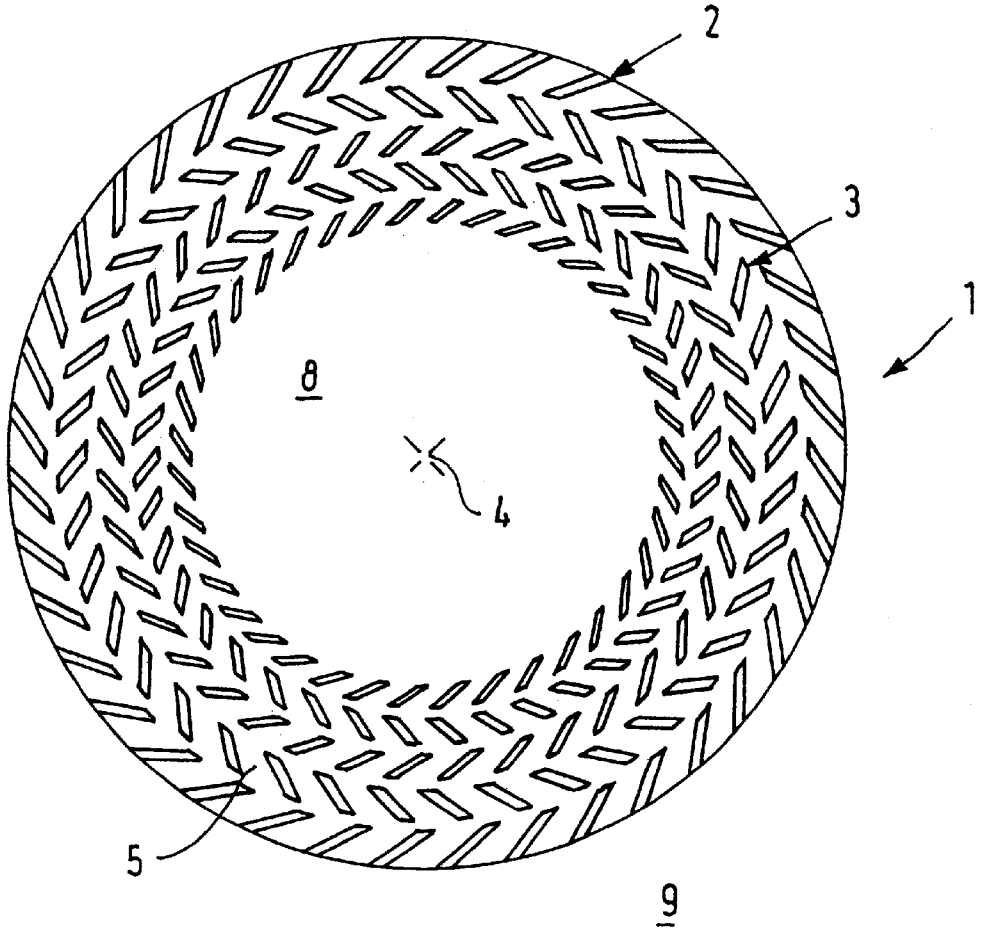
FIGS. 1 and 2 are sectional views through an embodiment of the seal in accordance with the present invention.
Figure 2:
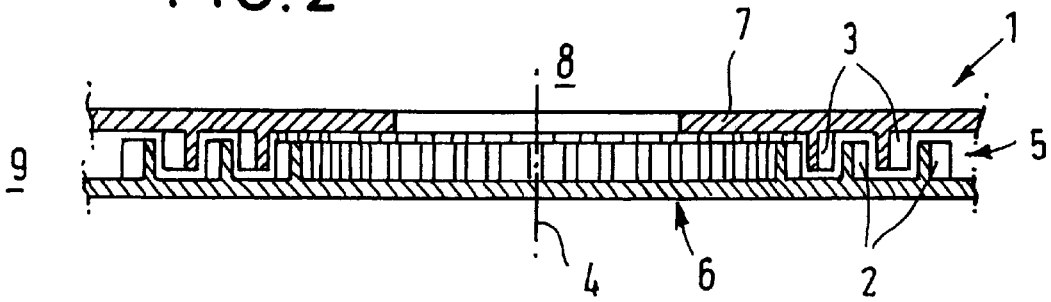

FIGS. 1 and 2 depict a seal 1 in accordance with the present invention with stationary rows of rotor blades 2 and rotating rows of rotor blades 3, the longitudinal axes of which extend in parallel to the rotational axis 4 of the rotating component. They are arranged in concentric rows about the rotational axis 4 and extend into the gap 5 which is to be sealed. The chambers which are to be mutually sealed off against each other and which are separated by the sealing gap 5 are generally designated as 8 and 9. The rows of the rotor blades 2 and the rows of stator blades 3 are arranged in alternating fashion. In the area of the gap 5 which is to be sealed they engage and have if a pumping action is desired in a manner basically known changing angles of incidence in the direction of the flow. From FIG. 2 it is apparent that the blades 2, 3 are components of the neighboring rotating resp. stationary components 6 and 7 respectively, between which there is located the gap 5 which is to be sealed.

Depicted in FIGS. 3 and 4 is a double flow embodiment of a seal 1 in accordance with the present invention. An inner group of rows of blades pumps the gases radially towards the inside (arrow 11), an outer group of rows of blades from inside to outside (arrow 12). Thus an equally effective separation of the chambers 8 and 9 which are to be sealed is achieved. This arrangement offers the benefit that in the chamber which is to be protected (e.g. 8) the vapor pressures of components in said chamber will not drop to inadmissibly low levels. In addition, this separation may be supported by the admission of inert gas between the two groups. The inert gas supply is effected through the stationary component 6. An inlet bore is depicted (also several may be provided) and designated as 14.

Figure 5:
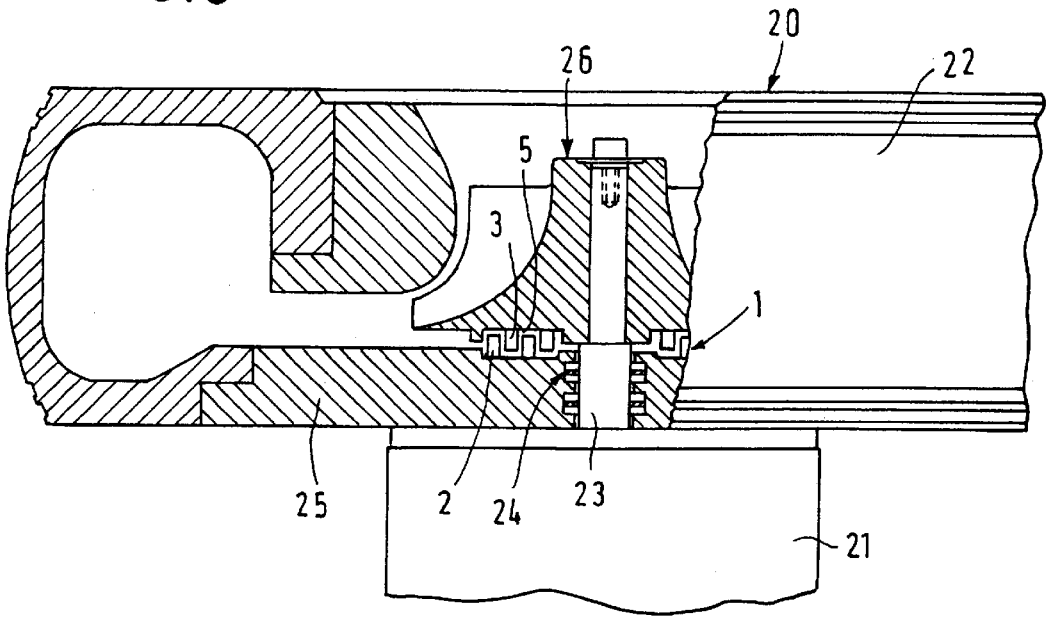
FIGS. 5 and 6 are embodiments where the rotors are cantilevered.

Depicted in FIG. 5 is the way in which the present invention is applied in a blower 20. It consists of a drive section 21 in which the drive motor, not depicted, is accommodated, and the gas pumping section 22. The drive motor drives a shaft 23 which is guided as gas-tight as possible (labyrinth seal 24) through the flange 25 of the drive's housing. Affixed to the unoccupied end of the shaft 23 is blower wheel 26. To support the labyrinth seal 24, a seal 1 in accordance with the present invention has been implemented in the gap 5 between the bottom side of blower wheel 26 and the flange 25. The flange 25 carries the rows of stator blades 2, the blower's wheel 26 carries rotating rows of blades 3 arranged concentrically about the shaft 23 and which engage in the area of gap 5. If the seal 1 shall have the effect of preventing the entry of gases pumped by blower wheel 26 into the motor chamber, then it is expedient to design the seal in such a manner that it exhibits a pumping action directed radially towards the outside.

Figure 6:
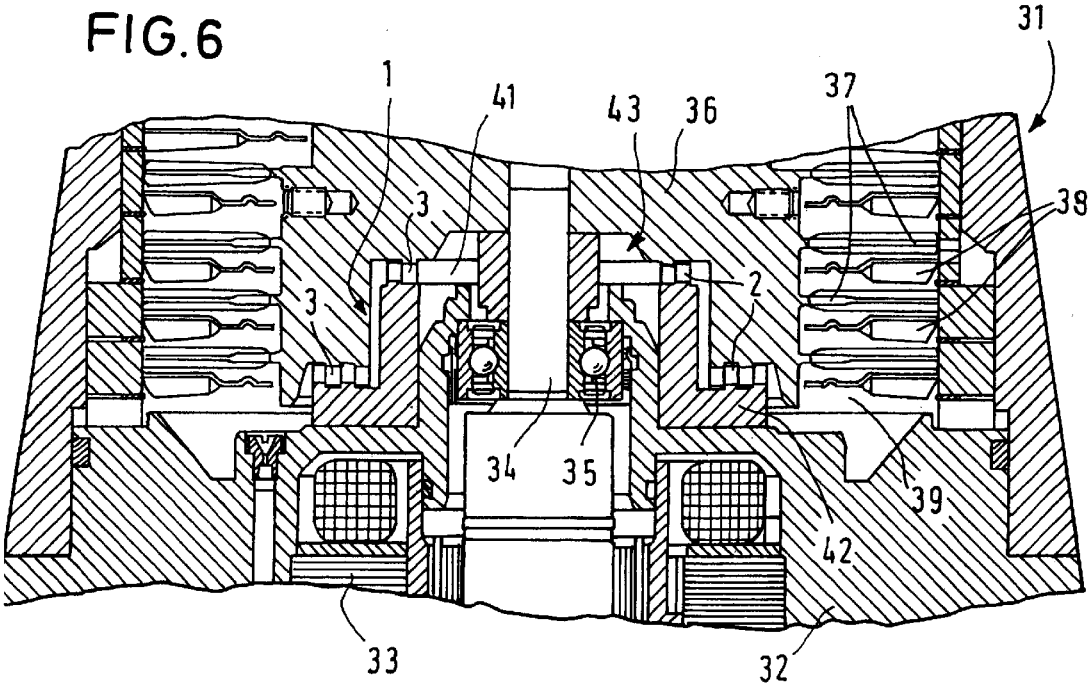

Depicted in FIG. 6 is a partial section through a turbomolecular pump 31, the base section of which is designated as 32. In the base section 32 with the drive motor 33, the shaft 34 is supported by bearing 35. The shaft 34 carries the rotor 36 with its rotor blades 37, which are located together with the stator blades 38 in the pump chamber 39. In order to effectively separate this pump chamber 39 from the motor and bearing chamber 41, a sealing system 1 designed in accordance with the present invention is provided. It comprises stator blades 2 arranged on two levels carried by a ring-shaped component 42, said component being L-shaped in its sectional view and encompassing the shaft 34. The rotor 36 is equipped with a recess 43 matching the contour of the ring-shaped component 42. The rotor blades 3 related to the stator blades 2 are affixed to the rotor 36. If in an embodiment of this kind a reliable separation of the chambers 39 and 41 is to be achieved for example, then it is expedient to design seal 1 in such a manner that the inner (upper) group of rows of blades 2, 3 has a pumping action directed towards the motor chamber 41 and the outer (lower) group of rows of blades 2, 3 has a pumping action directed towards the pump chamber 39. By admitting and inert gas between the two groups of rows of blades, the separating effect can even be improved. Both the ingress of hydrocarbons from the motor and bearing chamber 41 into the pump chamber 39, and also the ingress of detrimental (for example, corrosive or toxic) gases from the pump chamber 39 into the motor chamber 41 can be reliably avoided. The benefit also mentioned in connection with FIGS. 3 and 4 exists.

Figure 7:
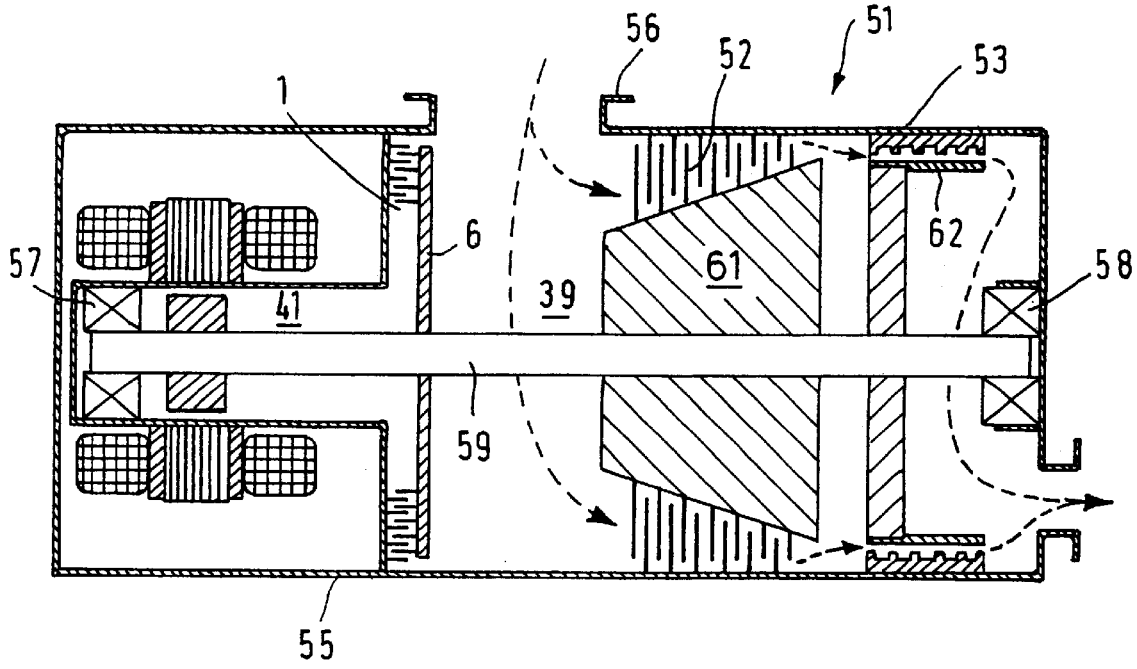
FIGS. 7 to 9 are embodiments of vacuum pumps equipped with a rotor system having bearings at both face sides.

Depicted in FIG. 7 is the application of a seal in accordance with the present invention in an axially compressing friction pump 51 according to the state-of-the-art. The friction pump 51 consists of a turbomolecular pumping stage 52 arranged on the suction side and a molecular pumping stage 53 arranged on the delivery side which may be designed as a Holweck pump (as depicted) or as a Gaede, Siegbahn, Englander or side channel pump. The seal 1 and the friction pump 51 are located in a joint housing 55 approximately cylindrical in shape with a side inlet 56. A shaft 59 supported by bearings (bearings 57, 58) at both face sides carries the rotating components in each instance (rotor disk 6 of the seal 1, rotor 61 of the turbomolecular pumping stage 52, cylinder 62 of the Holweck pumping stage 53). The side inlet 56 of the pump 51 opens between the seal 1 and the axially compressing pumping stages 52, 53. The outlet 64 of the pump 51 is located on the delivery side of the molecular pumping stage 53.

The special feature of the solution in accordance with FIG. 7 is, that the drive motor 68 is located on the high vacuum side of the axially pumping pump 51 (and not, as is common, on the delivery side of the Holweck pumping stage 53). In that the seal 1 is located between the inlet 56 and the drive motor 68, a relatively high pressure (for example $1\times10^{-2}$ mbar) can be maintained in motor chamber 41. The usage of high vacuum capable materials in motor chamber 41 is not required.

Figure 8:
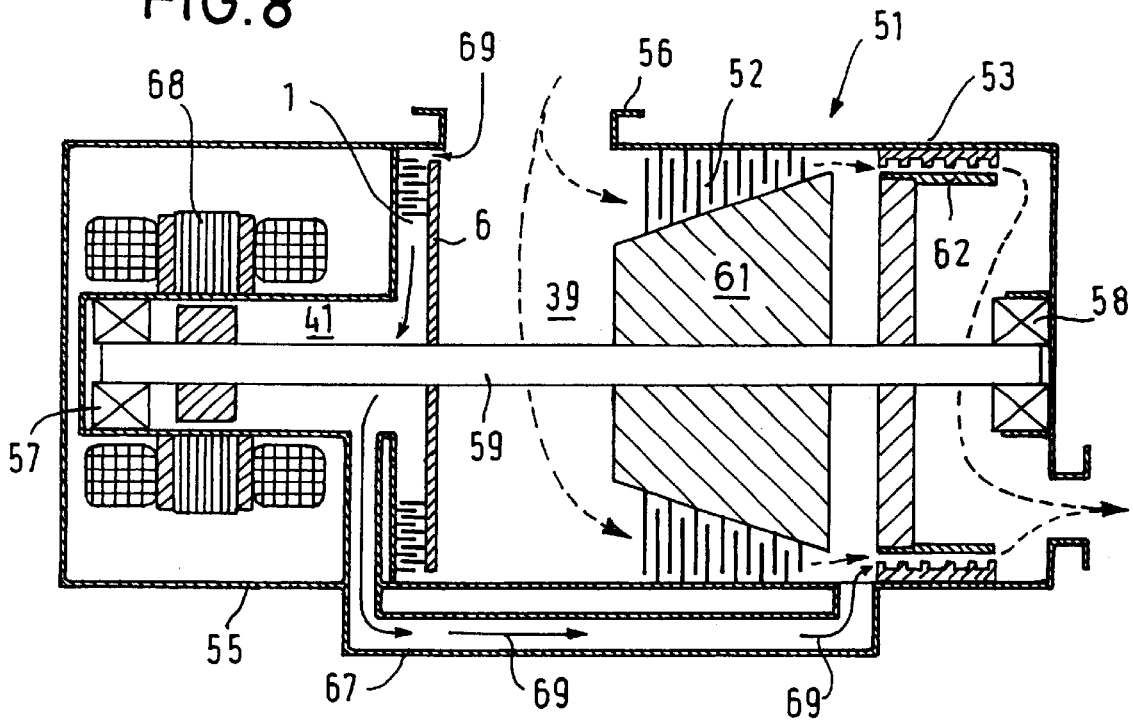

The embodiment in accordance with FIG. 8 differs from that in accordance with FIG. 7 in that the seal 1 has a pumping action directed radially from the outside to the inside. Moreover, a bypass 67 is connected to the motor chamber 41 said bypass being linked to the suction side of the molecular pumping stage 62. In line with the entered arrows 69, the gases pumped by the seal 1 enter through the motor chamber 41 into the bypass 67 and from there into molecular pumping stage 53. In this way, maintaining of a forevacuum pressure in the motor chamber 41 is ensured. Moreover, the seal 1 supports the pumping capacity of the turbomolecular pumping stage 52 without significantly increasing the total length of the pump 51.

Figure 9:
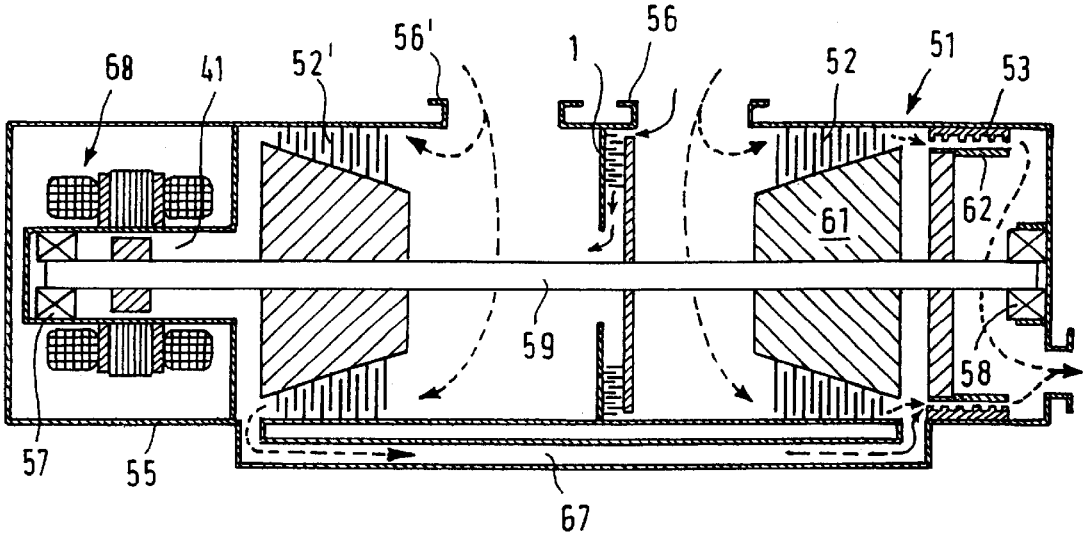

Depicted in FIG. 9 is an embodiment of a pump 51 for deployment in multi-chamber systems, two chamber systems in this instance. Such systems are, for example, analytical instruments having several chambers which need to be evacuated down to different pressures. Thus the distance from the intake ports is given, often resulting in state-of-the-art systems in the necessity for relatively long cantilevered rotor systems requiring involved bearing arrangements.

The embodiment in accordance with FIG. 9 has two side inlets 56, 56'. These are separated from each other by at least one seal 1. The seal 1 is so designed that it has a pumping action from outside to inside. The inlet 56 "sees" the inlet area of the axially pumping friction pump 51 as well as the periphery of the seal 1 pumping from outside to inside. The outlet of the radially pumping seal 1 opens into the inlet area of a second turbomolecular pumping stage 52' to which the second inlet 56' is connected. The seal 1 effects a lower pressure at inlet 56 compared to that at inlet 56'. The drive motor 68 is located on the delivery side of the turbomolecular pumping stage 52'. This delivery side is linked via the bypass 67 to the suction side of the molecular pumping stage 53.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A seal between a rotating part and a stationary part in which at least one of the parts is provided with projections which protrude into a radially extending seal gap so that both parts are provided with engaging projections which extend in an axial direction, which projections are located concentrically in relation to an axis of rotation of the rotating part and are designed as rows of blades.

2. The seal according to claim 1, wherein the rows of blades provide a pumping action.

3. The seal according to claim 2, wherein the seal is of the double flow type.

4. The seal according to claim 3, wherein the properties of the rows of blades of the double flow seal are selected in such a manner that a direction of the pumping action of the outer rows of blades is opposed to a direction of the pumping action of the inner rows of blades.

5. The seal according to claim 4, wherein an inert gas inlet is defined between the inner and outer rows of blades forming the double flow seal.

6. The seal according to claim 1, wherein the seal is part of a blower or a pump and is located between a pump chamber and a motor chamber.

7. The seal according to claim 6, wherein the seal has a pumping action directed towards the pump chamber.

8. The seal according to claim 6, wherein the seal is part of a turbomolecular pump, said seal having a pumping action directed towards the motor chamber, the motor chamber being linked through a bypass to a forevacuum pumping stage.

9. The seal according to claim 8, wherein the motor chamber is located at a suction side of the turbomolecular vacuum pump.

10. The seal according to claim 1, wherein the seal is part of a turbomolecular vacuum pump having at least two inlets, said seal being located between the inlets.

11. The seal according to claim 10, wherein the seal has a pumping action, a periphery of the seal being linked with a first inlet area and its center with a second inlet area.

12. A seal assembly comprising:

first and second parts which define a gap therebetween, the first and second parts being rotatable relative to each other about an axis of rotation;

a first ring of blades projecting from the first part into the seal gap in a direction parallel to the axis of rotation;

a second ring of blades projecting into the seal gap in a direction parallel to the axis of rotation, the first and second rings of blades being disposed contiguous to each other;

at least one of the rows of blades being skewed relative to a circumferential direction such that the skewed blades provide a pumping action within the seal gap.

* * * * *